US006189298B1

(12) United States Patent
Kuji et al.

(10) Patent No.: US 6,189,298 B1
(45) **Date of Patent: *Feb. 20, 2001**

(54) METHOD AND APPARATUS FOR OPENING A PACKAGE UTILIZING BONDED PORTIONS THEREOF

(75) Inventors: Yasunori Kuji; Kazuo Sasaki, both of Tokyo (JP)

(73) Assignee: Nippon Paper Industries Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/236,387

(22) Filed: Jan. 25, 1999

(30) Foreign Application Priority Data

Jan. 30, 1998 (JP) ..... 10-032271

(51) Int. Cl.[7] ..... B65B 43/26
(52) U.S. Cl. ..... 53/492; 53/381.2; 414/414
(58) Field of Search ..... 414/412, 414; 53/492, 381.1, 381.2, 382.1

(56) References Cited

U.S. PATENT DOCUMENTS 3,753,331 * 8/1973 Sato ..... 53/382.1
4,696,615 * 9/1987 Ettischer et al. ..... 53/381.2
5,048,267 9/1991 Kudo et al. ..... 53/492
5,059,082 * 10/1991 Tanttu et al. ..... 53/381.2
5,475,967 * 12/1995 Levi ..... 53/381.2
5,758,362 * 6/1998 Focke et al. ..... 53/382.1

FOREIGN PATENT DOCUMENTS 62-217828 11/1987 (JP) .
62-271827 11/1987 (JP) .

* cited by examiner

*Primary Examiner*—Eugene Kim
(74) *Attorney, Agent, or Firm*—Armstrong, Westerman, Hattori, McLeland & Naughton

(57) ABSTRACT

At a top face of a substantially parallelepipedic package, plate members having cutting blades at side edges thereof are inserted into a gap between a pair of bonded flaps of packaging material on the one hand and, on the other, packaged items and folded edges of the packaging material to cut the packaging material along the edges of the top face. The cut portions of the packaging material are opened with suction pads, and holding members of an unloader are inserted into two ends of the package from the opened top face to hold and take out the packaged items.

5 Claims, 8 Drawing Sheets

METHOD AND APPARATUS FOR OPENING A PACKAGE UTILIZING BONDED PORTIONS THEREOF

BACKGROUND OF THE INVENTION

1. Field of the Invention

The present invention relates to a method and apparatus for automatically cutting a packaging material wrapping of a substantially parallelepipedic package at a predetermined position thereof and opening the package, the package being formed by wrapping packaged items in the packaging material in such a way that the package has a pair of bonded flaps at each of at least three adjacent faces thereof.

2. Description of Background Art

There are rectangular paralelpiped-shaped paper containers for liquid foodstuffs, e.g. milk or juice, such as that shown in FIG. 19. Such a paper container blank 2 is folded flat as shown in FIG. 20 so that it will not be bulky when stored. Then, as shown in FIG. 1, a large number of paper container blanks 2 are put together and wrapped in a bundle with a packaging material 3 so as to be stored in the form of an approximately parallelepipedic package 1. The package 1 is opened when the paper container blanks 2 are used to fill a liquid foodstuff, or the like, thereinto.

The package-opening operation has heretofore been performed by hand under normal circumstances. That is, the steps of cutting the packing material at a predetermined position thereof, opening the package, and taking out the paper container blanks are usually carried out by a manual operation.

However, a machine is used to perform all the operations of unfolding each flat-folded paper container blank into a rectangular parallelpiped shape, forming a bottom of the paper container blank, filling it with a liquid foodstuff, or the like, and sealing the paper container. Therefore, a great deal of labor is required to open each package by a manual operation in conformity to the machine operation. Thus, the manual package opening operation is inefficient.

To solve the inefficiency problem, a method has been proposed in which the packaging material is mechanically cut to open the package by using a cutting blade [for example, see U.S. Pat. No. 5,048,267 and Japanese Patent Application Unexamined Publication (KOKAI) Nos. 62-271827 and 62-271828]. However, the package 1 is in such a condition that there is substantially no gap between the packaging material 3 and the packaged items 2, which are paper container blanks. Therefore, if a cutting blade is carelessly applied to the packaging material 3, the packaged items 2 may be damaged, resulting in a failure fatal to paper containers, e.g. ultimate leakage of liquid.

SUMMARY OF THE INVENTION

An object of the present invention is to provide a method and apparatus capable of automatically and efficiently opening a substantially parallelepipedic package without damaging packaged items by making good use of bonded flaps of the package that lie outside three faces thereof.

To attain the above-described object, the present invention provides a method of opening a substantially parallelepipedic package wrapped with a packaging material. The package has a pair of flaps bonded to each other at each of three faces of the package. At at least one of the three faces, a plate member is inserted into a space between the flaps on the one hand and, on the other hand, packaged items and a folded edge of the packaging material, and the packaging material is cut along the side edges of the plate member by using cutting blades, thereby opening the package.

The plate member may be a plate member having cutting blades on both side edges thereof, so that the packaging material is cut by inserting the plate member into the above-described space. Alternatively, the packaging material may be cut by moving cutting blades, which are provided separately from the plate member, along both side edges of the plate member.

The plate member may be inserted into the space from each side of the package, thereby enabling the package to be surely opened even when folded edges of the packaging material are present at both sides of the package.

When the plate member is to be inserted into the above-described space, only the bonded flaps may be raised with suction pads. By doing so, the plate member can be surely and readily inserted into the space. If the bonded flaps cut at one side thereof and the folded edge are opened with respective suction pads, the package opening operation can be performed without damaging the packaged items.

In addition, the present invention provides a method of opening a substantially parallelepipedic package wrapped with a packaging material. The package has a pair of flaps bonded to each other at each of three faces of the package. At the top face among the three faces, a plate member is inserted into a space between the flaps on the one hand and, on the other hand, packaged items and folded edges of the packaging material, which are folded from the side faces of the package. The packaging material is cut along at least one edge of the top face with a cutting blade. The cut portion of the packaging material is opened by using suction pads. The folded edges are opened outwardly with suction pads. A pair of holding members are inserted into two ends of the package from the opened top face to hold and take out the packaged items from the package.

In addition, the present invention provides a package opening apparatus including a package-opening table for placing thereon a substantially parallelepipedic package formed by wrapping packaged items in a packaging material in such a way that the package has a pair of bonded flaps at each of at least three adjacent faces thereof. The apparatus further includes suction pads for holding the bonded flaps by suction that are formed on a face of the package parallel to the package-opening table, thereby forming a gap between the bonded flaps held by suction and the packaged items. A plate member is inserted into the gap between the bonded flaps and the packaged items. The plate member has cutting blades at the side edges thereof to cut the bonded flaps along edges of the face of the package. A carriage supports and guides the plate member so that the plate member is capable of advancing and withdrawing with respect to the direction in which it is inserted into the gap. The apparatus further includes suction pads for removing the cut bonded flaps from the face of the package, and suction pads for opening a folded edge of the packaging material lying under the bonded flaps when folded, thereby opening the face of the package. In addition, the apparatus includes a holder for holding the packaged items that is capable of advancing toward and withdrawing from the opened face of the package.

In the above-described package opening apparatus, the cutting device may be formed from a plate member and cutting blades movably provided to cut the packaging material along the side edges of the plate member.

Noting that a substantially parallelepipedic package that is mechanically wrapped with a packaging material has a pair of bonded flaps at each of three faces thereof, the present inventors invented a package opening method and apparatus that enable the package to be opened automatically and efficiently without damaging the packaged items. That is, at at least one of the three faces of the packages, a plate member is inserted into a space between the bonded flaps and a folded edge of the packaging material, and the packaging material is cut along the side edges of the plate member by using cutting blades, thereby opening the package.

To cut the packaging material along the edges of a face of the package where the bonded flaps are present by using the plate member, if cutting blades are provided on the side edges of the plate member, the packaging material can be cut simply by inserting the plate member. The packaging material can also be cut by pressing and moving cutting blades, which are provided separately from the plate member, along the side edges of the plate member inserted in the space between the bonded flaps and the folded edge. In a case where both ends of a pair of bonded flaps are present at both sides of a face of the package (i.e. the top face), plate members that are provided separately can be inserted from both sides of the space.

In the case of such a substantially parallelepipedic package, if one face thereof is opened, the packaged items can be taken out of the package by holding them. If two faces of the package are opened, the packaged items can be taken out of the package by pushing them. Therefore, according to the above-described method, the packaging material is cut along at least three edges of one face of the package, and the cut portion of the packaging material is removed by using suction pads to thereby open the face of the package. Furthermore, a folded edge of the packaging material, which is folded from an adjacent face and lies under the cut portion of the packaging material before it is opened, is also removed by using suction pads. Then, a pair of holding members are inserted into two ends of the package from the opened face to hold the packaged items, thereby enabling them to be taken out of the package. At this time, it is necessary to secure the package from the outside thereof with suction pads, and so forth, so that the packaging material will not move. Alternatively, the packaging material needs to be pulled downwardly.

The package opening apparatus according to the present invention for carrying out the above-described package opening method includes a package-opening table for placing thereon an approximately parallelepipedic package formed by wrapping packaged items in a packaging material in such a way that the package has a pair of bonded flaps at each of at least three adjacent faces thereof. The apparatus further includes suction pads for holding the bonded flaps by suction that are formed on a face of the package parallel to the package-opening table, thereby forming a gap between the bonded flaps held by suction and the packaged items. A plate member is inserted into the gap between the bonded flaps and the packaged items. The plate member has cutting blades at the side edges thereof to cut the bonded flaps along the edges of the face of the package. A carriage supports and guides the plate member so that the plate member is capable of advancing and withdrawing with respect to the direction in which it is inserted into the gap. The apparatus further includes suction pads for removing the cut bonded flaps from the face of the package, and suction pads for opening a folded edge of the packaging material lying under the bonded flaps when folded, thereby opening the face of the package. In addition, the apparatus includes a holder for holding the packaged items that is capable of advancing toward and withdrawing from the opened face of the package.

In the above-described package opening apparatus, the packaging material is cut along the parallel side edges of the face of the package with the cutting blades provided on the side edges of the plate member. However, the arrangement may be such that the plate member is not provided with cutting blades, but cutting blades provided separately from the plate member are moved along the side edges of the plate member inserted as a backplate, thereby cutting the packaging material. In this case, the backplate has moderate mechanical strength and adequate thickness. Therefore, there is no likelihood of the cutting blades reaching the packaged items when they are pressed and moved to cut the packaging material. It is also possible to provide the side edge portions of the backplate with straight grooves for fitting with the cutting blades. In a case where both ends of a pair of bonded flaps are present at both sides of a face of the package (i.e. the top face), it is necessary to insert plate members from both sides of the face. Accordingly, a combination of a plate member and a carriage that supports and guides it needs to be provided on each side of the package.

At a face of a substantially parallelepipedic package where a pair of flaps of a packaging material are bonded to each other, there is only a folded edge of the packaging material, which is folded from another face, at a side of the face closer to an end of the bonded flaps, and it is unnecessary to cut the packaging material at this side of the face. Therefore, at the top face of the package where two ends of the bonded flaps are present at both sides thereof, cutting the packaging material along at least one edge of the bonded flaps is equivalent to cutting the face along three edges thereof. Accordingly, the package opening apparatus of the present invention is provided with suction pads for suction-holding and opening the cut bonded flaps to open the face (the same suction pads as used to insert the plate member are used for this purpose). The apparatus is further provided with suction pads for suction-holding and opening the folded edges of the packaging material, which are folded from other faces at both sides of the face concerned. In addition, the apparatus is provided with a holder for taking out the packaged items from the face (top face) opened by the suction pads.

The holder has a pair of holding members that are inserted into the gaps between the packaging material and the packaged items at both sides of the opened face of the package. The holding members are moved toward each other to hold the packaged items and remove the packaged items from the packaging material.

To remove the packaged items from the packaging material, suction pads are provided to secure the packaging material by suction-holding it from the outside of the package.

When an end of a pair of bonded flaps at a face of a substantially parallelepipedic package is present only at one side of the face, the other end of the bonded flaps is folded over a neighboring face of the package. Therefore, it is necessary to cut the packaging material along one edge of the bonded flaps and also along an edge perpendicularly intersecting that edge. In such a case, the package is placed on the table in such a way that the end of the bonded flaps faces upward, and the plate member is inserted downwardly along the bonded flaps.

The above and other objects, features and advantages of the present invention will become more apparent from the following description of the preferred embodiments thereof, taken in conjunction with the accompanying drawings.

DESCRIPTION OF THE PREFERRED EMBODIMENTS

The present invention will be described below by way of embodiments and with reference to the accompanying drawings.

Figure 1:
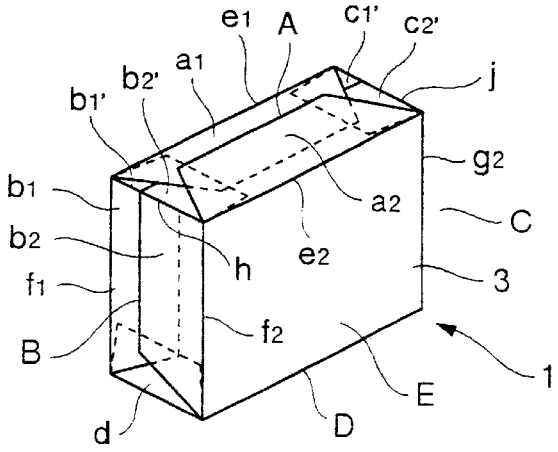
FIG. 1 is a perspective view of a package to be opened by the present invention, showing the way in which it is wrapped with a packaging material.
Figure 19:
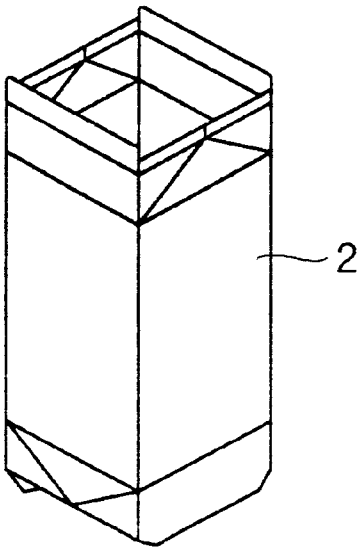
FIG. 19 is a perspective view showing one example of an assembled packaged item obtained from the package opening method and apparatus according to the present invention.
Figure 20:
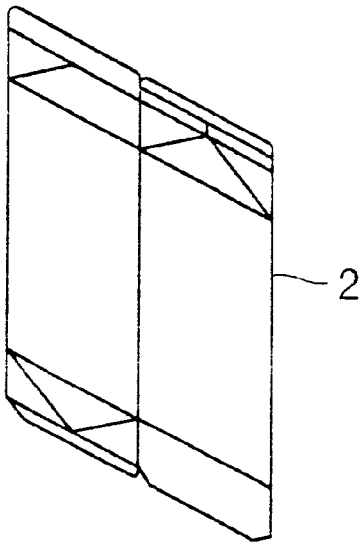
FIG. 20 is a perspective view showing the item of FIG. 19 as folded flat when packaged as one example of packaged items in the package opening method and apparatus according to the present invention.

An example of packaged items 2 to which the package opening method and apparatus of the present invention are applied is a rectangular parallelpiped-shaped container blank (see FIG. 19) for containing a liquid foodstuff, such as milk or juice. The container blank is folded flat into a sheet-like shape (see FIG. 20) so that it will not be bulky when stored. A large number of such folded container blanks are put together such that the obverse side of one sheet-shaped container blank lies on the reverse side of another container blank. The bundle of container blanks is wrapped in a packaging material automatically by using a machine to form a package as shown in FIG. 1. The package has an approximately parallelepipedic shape. It should be noted that packaged items to which the present invention is applicable are not necessarily limited to the above. The present invention is applicable to any packaged items that are automatically wrapped with a packaging material by using a machine to form an approximately parallelepipedic package as shown in FIG. 1.

As shown in FIG. 1, the package 1 is formed as follows. First, a packaging material 3 is pressed on the bottom face D of the bundle of packaged items 2 and then folded over two faces E and two side faces B and C of the bundle of packaged items 2. A folded edge d is formed on each side face. At the side face B, two flaps $b_1$ and $b_2$ folded over the side face B are bonded to each other over the folded edge d, which is folded from the bottom face D. Similarly, at the side face C opposite to the side face B, two flaps $c_1$ and $c_2$ folded over the side face C are bonded together over the associated folded edge d. In this case, the extended portions of the bonded flaps on the side faces B and C are folded over the top face A to form folded edges $b_1'$, $b_2'$, $c_1'$, and $c_2'$. Thereafter, two flaps $a_1$ and $a_2$, which are folded over the top face A, are bonded to each other. The starting end of each pair of bonded flaps forms a V-shape. The folded edges and the associated bonded flaps are not bonded to each other.

Figure 2:
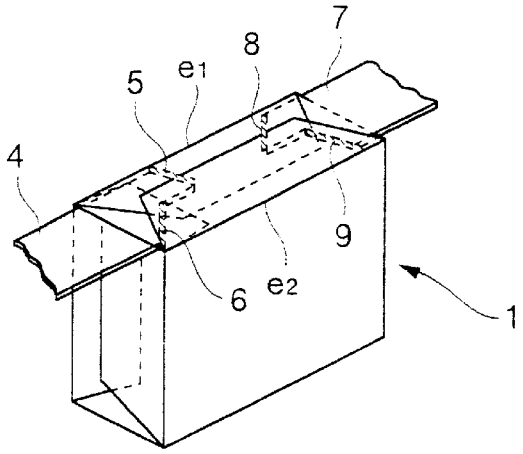
FIG. 2 is a perspective view showing the package opening method according to the present invention.

The present invention provides a method of opening the substantially parallelepipedic package 1 in which the packages items 2 are wrapped in a packaging material 3 in such a way that the package 1 has a pair of bonded flaps at each of at least three adjacent faces thereof. The present inventors noted that the pairs of flaps $b_1$ and $b_2$, flaps $a_1$ and $a_2$ and flaps $c_1$ and $c_2$ on the three faces B, A and C are bonded to each other but not bonded to the folded edges d, $b_1'$, $b_2'$, $c_1'$ and $c_2'$ of the packaging material 3, which lie thereunder. Thus, according to the package opening method of the present invention, a plate member 4 with cutting blades 5 and 6 is inserted into the space between a pair of bonded flaps and the associated folded edge or edges, thereby cutting the bonded flaps along edges formed between the bonded flaps and other faces adjacent thereto, and thus opening the package 1. Accordingly, the package opening method allows the package 1 to be opened at any of the three faces, i.e. the top faces A and the two side faces B and C. As one example, a case where the top face A is opened will be described below with reference to FIG. 2. First, the package 1 is placed with the top face A facing upward, and the cutting plate member 4 is inserted from the direction of the side face B into the space between the folded edges $b_1'$ and $b_2'$, which are folded from the side face B, and the two bonded flaps $a_1$ and $a_2$ and then moved toward the side face C. The cutting plate member 4 has cutting blades 5 and 6 provided on both side edges thereof. The cutting blades 5 and 6 cut the packaging material 3 along edges $e_1$ and $e_2$ formed between the bonded flaps $a_1$ and $a_2$ and other faces adjacent thereto. When the top face A is to be opened, because of the presence of the folded edges $c_1'$ and $c_2'$, which are folded from the side face C, the cutting plate member 4 is likely to be caught on the folded edges $c_1'$ and $c_2'$, causing a trouble, if the cutting plate member 4 is moved as far as the side face C. Therefore, the cutting plate member 4 inserted from the side face B is moved as far as an intermediate position of the bonded flaps $a_1$ and $a_2$ and then returned. Then, a similar plate member 7 with cutting blades is similarly inserted into the space between the bonded flaps $a_1$ and $a_2$ and the folded edges $c_1'$ and $c_2'$, which are folded from the side face C. Thus, the portion of the packaging material 3 left uncut by the cutting plate member 4 is cut along the edges $e_1$ and $e_2$ with cutting blades 8 and 9 provided on both side edges of the cutting plate member 7. It should be noted that the cutting blades 5 and 6 of the plate member 4 are staggered, and the cutting blades 8 and 9 of the plate member 7 are staggered in an opposite positional relation to the cutting blades 5 and 6 for the purpose of leaving an uncut portion on one of the edges $e_1$ and $e_2$. When the packaging material 3 is to be cut completely along the edges $e_1$ and $e_2$, the two cutting blades of each plate member should be provided at the same position of the distal end of the plate member. Thus, the cutting blades of each plate member should be provided at desired positions according to need. Furthermore, to insert the cutting plate member 4 into the space between the folded edges $b_1'$ and $b_2'$ and the two bonded flaps $a_1$ and $a_2$, the flaps $a_1$ and $a_2$ are raised by using suction pads, and the cutting plate member 4 is inserted into the gap formed between the bonded flaps $a_1$ and $a_2$ and the folded edges $b_1'$ and $b_2'$, thereby enabling the cutting plate member 4 to be inserted surely and easily (detailed later).

Figure 3:
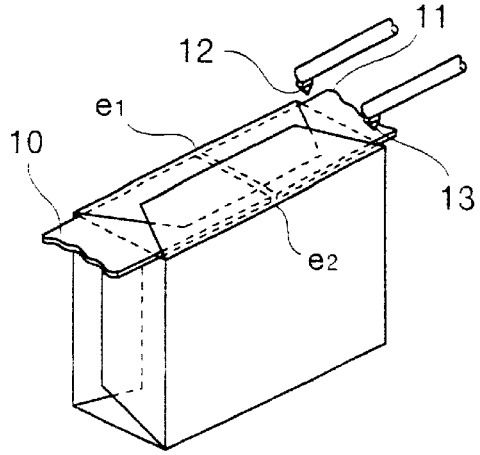
FIG. 3 is a perspective view showing another example of the package opening method according to the present invention.

Although the above-described package opening method (shown in FIG. 2) uses the two cutting plate members 4 and 7, if a combination of a backplate serving as an underlay and cutting blades which are separate from the backplate is used, the packaging material 3 can be cut even more reliably. More specifically, as shown in FIG. 3, the package 1 is placed with the top face A facing upward as in the case of the example shown in FIG. 2, and a plate member 10, which constitutes a backplate, is inserted from the direction of the side face B into the space between the folded edges $b_1'$ and $b_2'$, which are folded from the side face B, and the two bonded flaps $a_1$ and $a_2$. The plate member 10 is moved as far as an intermediate position on the top face A. Similarly, a plate member 11 is inserted from the direction of the side face C into the space between the bonded flaps $a_1$ and $a_2$ and the folded edges $c_1'$ and $c_2'$, which are folded from the side face C. The two plate members 10 and 11 constitute a backplate used as an underlay. Cutting blades 12 and 13, which are provided separately from the plate members 10 and 11, are moved along the side edges of the plate members 10 and 11, thereby cutting the packaging material 3 along the edges $e_1$ and $e_2$. In this case, the cutting blades 12 and 13 may be moved along the side edges of the plate members 10 and 11. Alternatively, the side edge portions of the plate members 10 and 11 may be provided with grooves that are engageable with the cutting blades 12 and 13. Plates having moderate mechanical strength and a thickness of the order of 3 millimeters are adequate for use as the plate members 10 and 11. Consequently, the packaging material 3 can be cut with the cutting blades 12 and 13 without damaging the packaged items 2. Rotary cutting blades may be used as the cutting blades 12 and 13.

The side faces B and C can also be cut in the same way as in the case of opening the top face A. More specifically, a plate member with cutting blades or a plate member serving as an underlay is inserted into the space between the folded edge d, which is folded from the bottom face D, and the two flaps $b_1$ and $b_2$ ($c_1$ and $c_2$), which are folded over each side face and bonded to each other, thereby cutting the package 1 along the edges $f_1$ and $f_2$ ($g_1$ and $g_2$) of the side face B (C). When the side face B or C is to be opened, a plate member with cutting blades or an underlay plate member is inserted only in one direction because there is only one folded edge d at an end of each side face from which the cutting plate member or the plate member is to be inserted, unlike the top face A, on which folded edges are present at both ends thereof. To cut the packaging material 3 also along the edge h or j at the upper end of each side face, cutting blades are moved along the edges $f_1$, $f_2$ and h of the side face B (by way of example) with the plate member inserted. In the case of a plate member with cutting blades, a cutting blade is also provided on the forward edge of the plate member. By doing so, the packaging material 3 can also be cut along the edge h or j.

After the packaging material 3 has been cut along the edges of the package 1, the cut portions of the packing material 3 are removed. Alternatively, the cut portions of the package 1 are unfolded. Then, the packaged items 2 are held and picked out of the package 1 from the open face by using a device described later. Alternatively, both side faces of the package 1 are opened, and the packaged items 2 are pushed out. Methods whereby the package 1 is opened and the packaged items 2 are taken out will be described below with reference to FIGS. 4 to 9.

Figure 4:
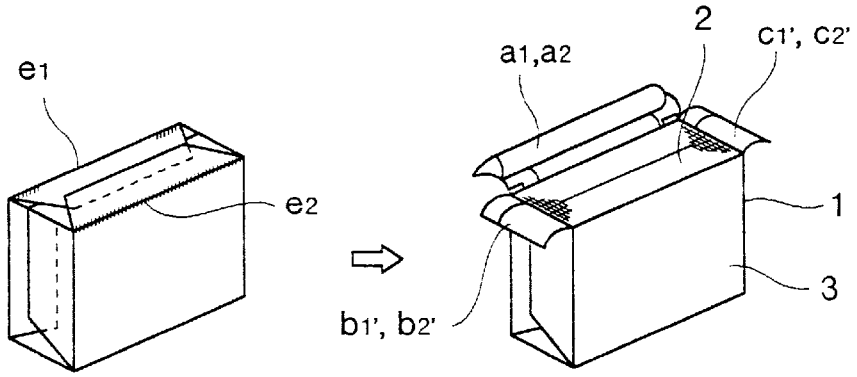
FIG. 4 is a perspective view showing one example of the way in which a package is opened by the method of the present invention.

FIG. 4 shows an example in which the package 1 is opened as follows. Cutting along one of the two edges of the top face A, that is, the edge $e_2$, is effected completely, but cutting along the other edge $e_1$ is partially effected from each end of the top face A as far as the terminating ends of the folded edges $b_1'$ and $b_2'$ ($c_1'$ and $c_2'$). Then the bonded flaps $a_1$ and $a_2$ are opened to the side where the uncut portion is present by using suction pads. Because the folded edges $b_1'$ and $b_2'$ and the folded edges $c_1'$ and $c_2'$, which are folded from both side faces B and C, are cut off from the bonded flaps $a_1$ and $a_2$, these folded edges are also opened by using suction pads and so forth. Thereafter, a pair of holding members are inserted into the package 1 along the two side faces B and C from the opened top face A to hold the packaged items 2 while the remaining packaging material 3 is being held with suction pads and so forth, as described later. Thus, the packaged items 2 can be taken out by raising the holding members or lowering the packaging material 3.

Figure 5:
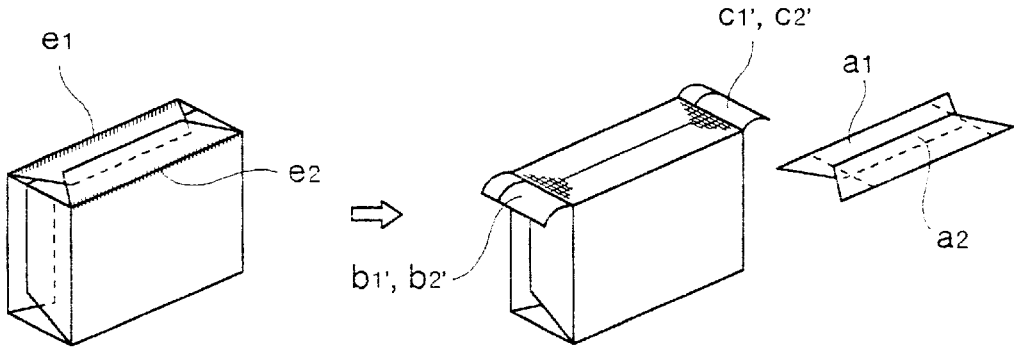
FIG. 5 is a perspective view showing another example of the way in which a package is opened by the method of the present invention.

FIG. 5 shows an example in which the packaging material 3 is cut completely along the two edges $e_1$ and $e_2$ of the top face A, and the cut flaps $a_1$ and $a_2$ on the top face A are removed by using suction pads. Furthermore, the cut folded edges $b_1'$ and $b_2'$ ($c_1'$ and $c_2'$), which are folded from each side face, are opened to both sides by using suction pads, and so forth. Thereafter, the remaining packaging material 3 is held with suction pads, and so forth, and while doing so, a pair of holding members are inserted into the package 1 along the two side faces B and C from the opened top face A to hold the packaged items 2, thereby enabling the packaged items 2 to be taken out in the same way as in the case of FIG. 4.

Figure 6:
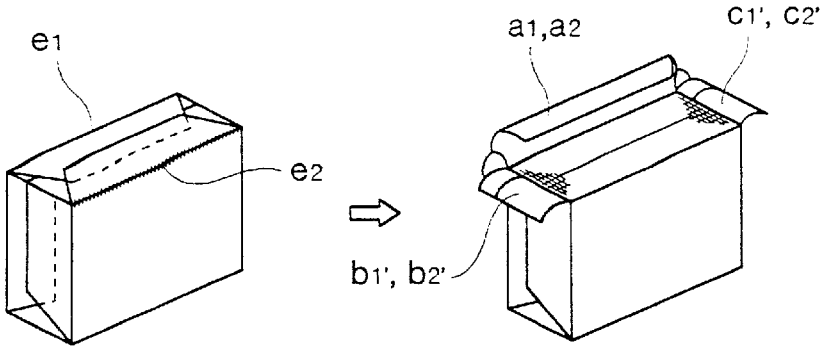
FIG. 6 is a perspective view showing still another example of the way in which a package is opened by the method of the present invention.

FIG. 6 shows an example approximately the same as the example shown in FIG. 4. The packaging material 3 is cut in such a way that cutting along one of the two edges of the top face A, that is, the edge $e_2$, is effected completely, but cutting along the other edge $e_1$ is not performed at all. Thereafter, an operation similar to that in the case of FIG. 4 may be carried out.

Figure 7:
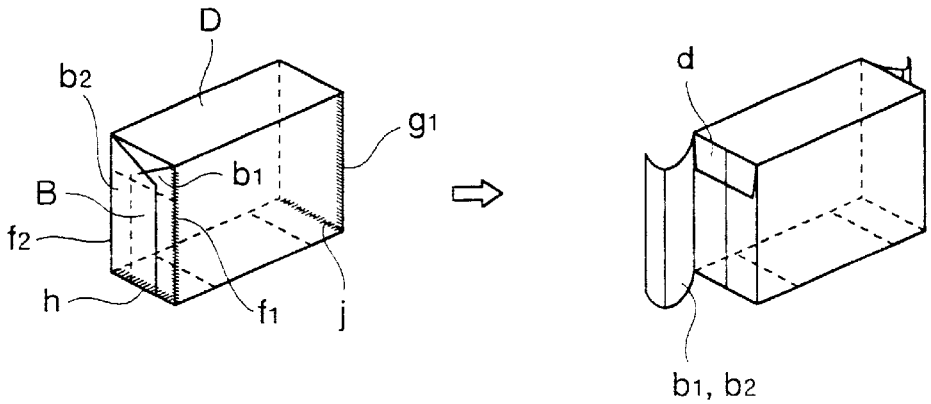
FIG. 7 is a perspective view showing a further example of the way in which a package is opened by the method of the present invention.
Figure 8:
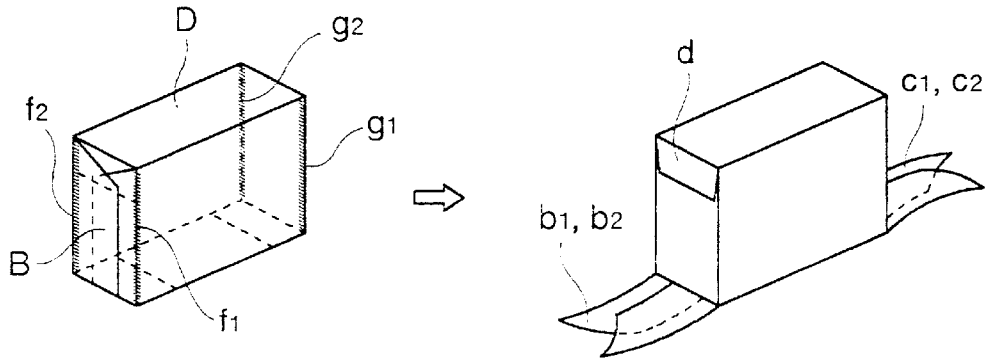
FIG. 8 is a perspective view showing a still further example of the way in which a package is opened by the method of the present invention.
Figure 9:
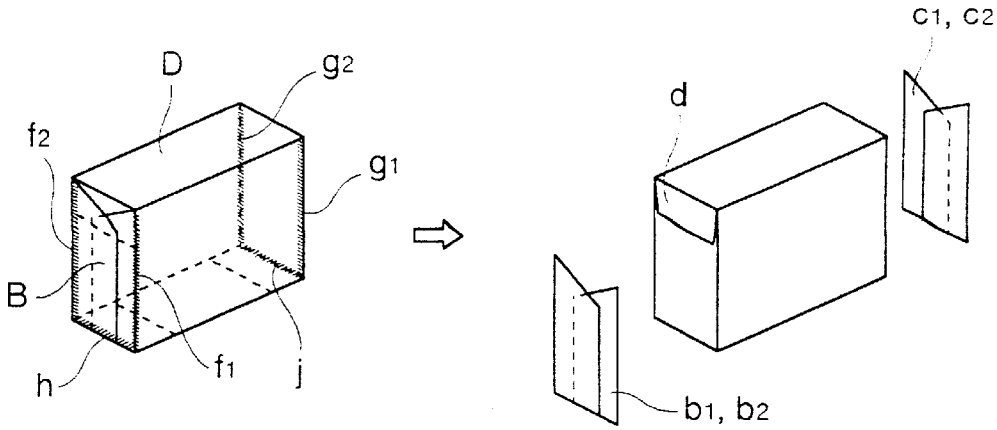
FIG. 9 is a perspective view showing a still further example of the way in which a package is opened by the method of the present invention.

FIGS. 7 to 9 show examples wherein the side faces B and C of the package 1 are opened. In this case, the package 1 is turned upside down. That is, the top face A faces downward, whereas the bottom face D faces upward. By doing so, it becomes easier to open the side faces B and C. More specifically, the package 1 is placed such that the V-shaped end of the bonded flaps on each side face is directed upward. A plate member with cutting blades or a plate member serving as an underlay is inserted downwardly into the space between the bonded flaps $b_1$ and $b_2$ ($c_1$ and $c_2$) on each side face and the folded edge d, which is folded from the bottom face D, thereby cutting the packaging material 3 along the two edges $f_1$ and $f_2$ ($g_1$ and $g_2$) of each of the side faces B and C.

FIG. 7 shows an example in which the packaging material 3 is cut at both side faces B and C of the package 1 along the edges $f_1$ and $g_1$ and the edges h and i at the boundaries between the top face A and the side faces B and C, and the cut portions are opened toward the edges $f_2$ and $g_2$, which are not cut, by using suction pads and so forth. In a state where the side faces B and C are open, the remaining faces of the package 1 are held stationary with pressure plates, suction pads, etc. In this state, a push rod is inserted into the package 1 from one side thereof to push out the packaged items 2. It should be noted that, in this case, the folded edges d, which are folded from the bottom face D, are left, but they will not interfere with the unpacking operation because when the packaged items 2 are pushed out, the folded edge d that is pushed by the packaged items 2 opens in the direction in which they are pushed out. In a case where the packaging material 3 is cut along the edges h and i at the boundaries between the top face A and the side faces B and C at the same time as the edges $f_1$, $f_2$, $g_1$ and $g_2$ of the side faces B and C are cut, a plate member is inserted to extend over the whole area of each side face, and in this state, a cutting blade is moved along each edge. It is also possible to use a plate member that has cutting blades along all the edges of the distal end portion thereof and to pass it downwardly through the space between the folded edge d and the associated bonded flaps to thereby cut off the bonded flaps.

FIG. 8 shows an example in which the packaging material 3 is cut along the edges $f_1$ and $f_2$ ($g_1$ and $g_2$) at each of the side faces B and C, and the cut portions are opened toward the top face A by using suction pads and so forth, thereby opening the side faces B and C.

FIG. 9 shows an example in which the packaging material 3 is cut along the edges $f_1$ and $f_2$ ($g_1$ and $g_2$) at each of the side faces B and C and along the edges h and j at the boundaries between the top face A and the two side faces B and C, and the cut portions are removed with suction pads and so forth, thereby opening the side faces B and C.

Next, an apparatus for carrying out the above-described package opening method will be described with reference to FIGS. 10 to 18.

Figure 10:
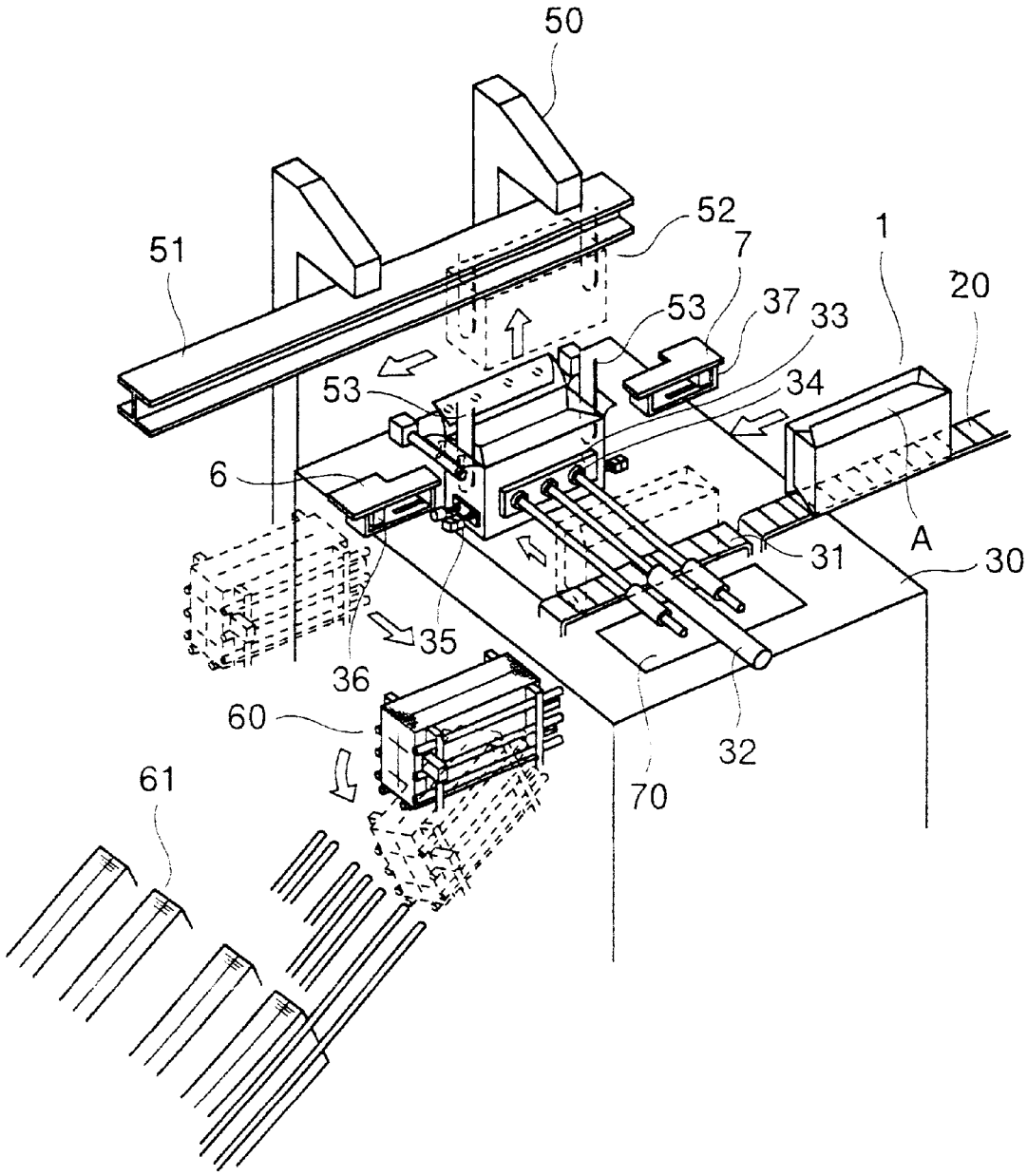
FIG. 10 is a perspective view showing the whole arrangement of a package opening apparatus according to the present invention.

FIG. 10 shows the whole arrangement of the apparatus. A package 1 is fed onto a package-opening table 30 by a feed conveyor 20. The package-opening table 30 is provided with a conveyor 31 on the extension of the feed conveyor 20. A package opening position is set on the far side of the conveyor 31 at a position on an imaginary line perpendicularly intersecting the conveyor 31. A packaging material discharge pocket 70 is provided on the near side of the conveyor 31 to receive a packaging material 3 after the package 1 has been opened. A pusher 32 is provided to move the package 1 from the conveyor 31 to the package opening position by pushing the package 1 in a direction perpendicular to the conveyor 31. A touch plate 33 is supported at the distal end of the pusher 32. The touch plate 33 extends in the longitudinal direction of one face of the package 1. Suction pads 34 are mounted on the touch plate 33. The package 1 is placed on the feed conveyor 20 in such a way that the top face A faces upward and the longitudinal axis of the package 1 extends in the forward direction of the feed conveyor 20. The package 1 fed by the feed conveyor 20 in this way is transferred to the conveyor 31 on the package-opening table 30 and moved to a center position on the package-opening table 30. At this position, the pusher 32 is activated to push the package 1 to the package opening position through the touch plate 33. At the package opening position, the package 1 is held at its lower part from each lateral side thereof by a retainer 35 having suction pads at a distal end thereof. Carriages 36 and 37 for supporting and guiding plate members 6 and 7 with cutting blades or plate members 10 and 11 are provided on both sides of the package opening position in the longitudinal direction thereof. The carriages 36 and 37 support and guide the cutting plate members 6 and 7, respectively, such that the cutting plate members 6 and 7 can advance and withdraw in the longitudinal direction of the top face A of the package 1. In addition, a top suction plate 39 having suction pads is provided. The top suction plate 39 acts on the top face A of the package 1 to hold a cut portion of the packaging material 3 by suction to thereby open the package 1. An unloader 50 is provided above the package opening position to take out the packaged items 2 from the opened package 1. The unloader 50 includes a rail 51 provided above the package 1 in parallel to the longitudinal direction of the package 1. The unloader 50 further includes a holder 52 that is movable along the rail 51 and also movable vertically. After the packaging material 3 forming the top face of the package 1 has been cut, the cut portion of the packaging material 3 is opened outwardly by using the top suction plate 39, and the folded edges, which are folded from both side faces of the package 1, are also opened. Consequently, the packaged items 2 are exposed directly to the outside. In this state, the holder 52 lowers, and a pair of holding members 53 and 53' thereof are inserted into spaces between the packaging material 3 and the packaged items 2 at both longitudinal ends of the package 1. Upon completion of the insertion, the holding members 53 and 53' at the two longitudinal ends move toward each other to hold the packaged items 2 under pressure. Then, the holder 52 moves upward. At this time, the packaging material 3 is held at its lower part by the suction pads and thus secured at the package opening position. Therefore, only the packaged items 2 can be removed from the packaging material 3. The packaged items 2 are kept held by the holder 52, and in this state, they are moved along the rail 51 to the outside of the package-opening table 30 and then lowered into a moving basket 60 prepared to receive them. Then, the moving basket 60 moves to supply the packaged items 2 into a magazine 61 of a machine (in this case, an apparatus in which paper container blanks, which are the packaged items 2, are formed by welding, and the containers thus formed are filled with a liquid foodstuff such as milk or juice and then sealed). Meanwhile, the packaging material 3, from which the packaged items 2 have been taken out, are kept held by the suction pads at the distal end of the pusher 32. In this state, the pusher 32 moves backward. Consequently, the packaging material 3 is dropped into the packaging material discharge pocket 70 provided in the package-opening table 30 and thus discharged.

Figure 11:
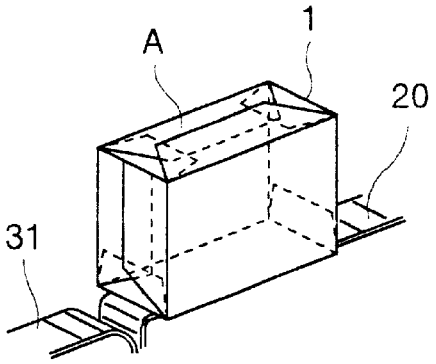
FIG. 11 is a perspective view showing the way in which a package is fed at one step in an operation carried out by the package opening apparatus of the present invention.
Figure 12:
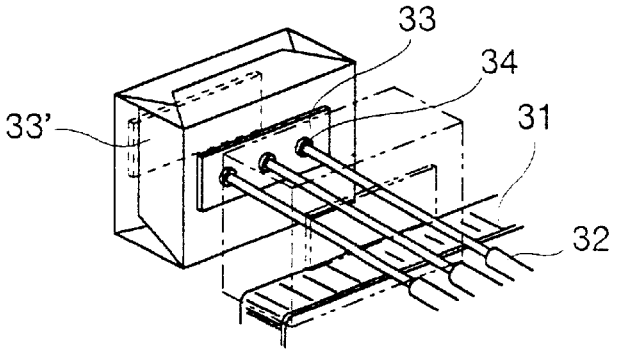
FIG. 12 is a perspective view showing the way in which the package is pushed with a pusher at one step in the operation of the package opening apparatus according to the present invention.
Figure 13:
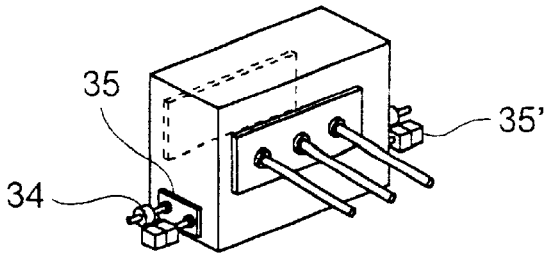
FIG. 13 is a perspective view showing the way in which the package is held stationary at a package opening position at one step in the operation of the package opening apparatus according to the present invention.
Figure 14:
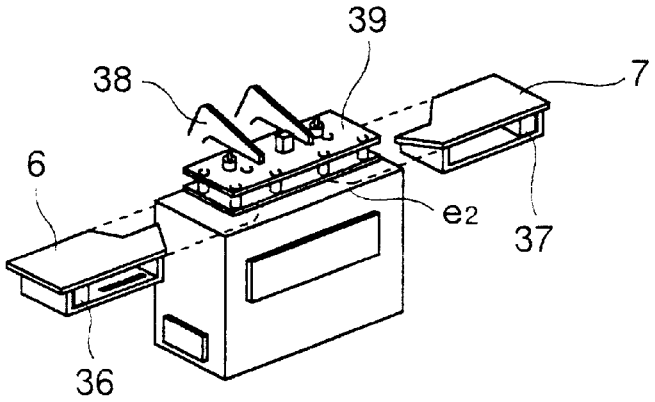
FIG. 14 is a perspective view showing the way in which the top face of the package is opened at one step in the operation of the package opening apparatus according to the present invention.
Figure 15:
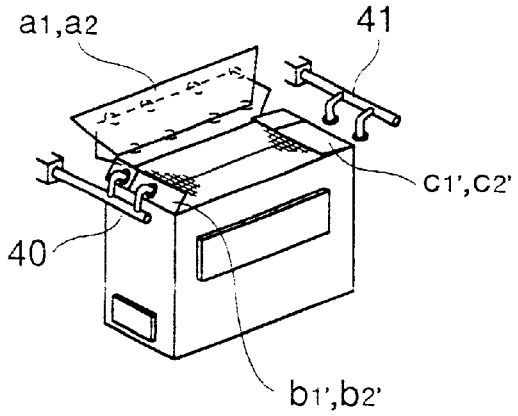
FIG. 15 is a perspective view showing the way in which cut portions of the package are being opened at one step in the operation of the package opening apparatus according to the present invention.
Figure 16:
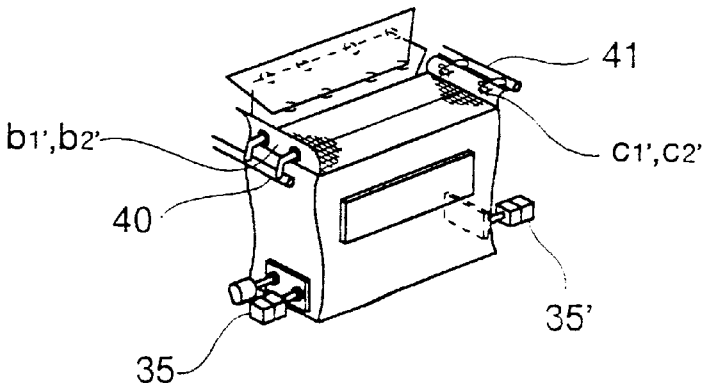
FIG. 16 is a perspective view showing the way in which the cut portions of the package have been opened at one step in the operation of the package opening apparatus according to the present invention.
Figure 17:
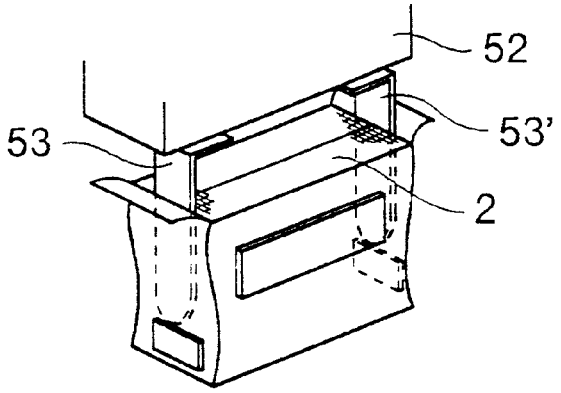
FIG. 17 is a perspective view showing the way in which a pair of holding members are inserted into the package at one step in the operation of the package opening apparatus according to the present invention.
Figure 18:
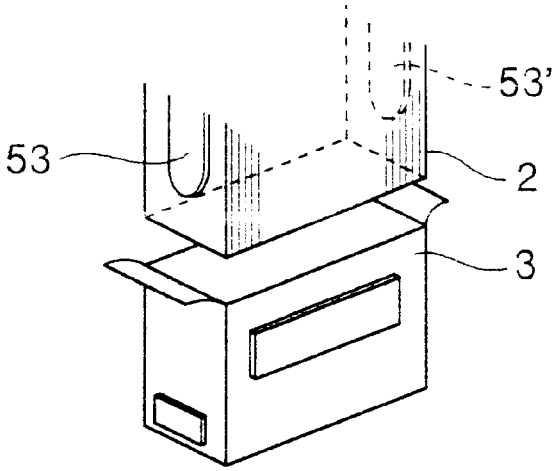
FIG. 18 is a perspective view showing the way in which packaged items are taken out at one step in the operation of the package opening apparatus according to the present invention.

The details of the package opening operation carried out on the package-opening table 30 will be described below with reference to FIGS. 11 to 18. FIG. 11 shows the package 1 that is going to move from the feed conveyor 20 to the conveyor 31 on the package-opening table 30. The package 1 is fed in such a way that the top face A faces upward and the longitudinal axis of the package 1 extends in the forward direction of the feed conveyor 20. FIG. 12 shows the way in which the package 1 is moved from the conveyor 31 to the package opening position by activating the pusher 32 through a pneumatic cylinder or the like. In this case, a touch plate 33' is also applied to the rear side of the package 1 so that the package 1 will not fall down. Thus, the package 1 is moved in the state of being sandwiched between the two touch plates 33 and 33'. When the package 1 reaches the package opening position, the retainers 35 and 35' advance toward the side faces of the package 1 to support it under pressure, thereby positioning he package 1. After the package 1 has been positioned, as shown in FIG. 14, the top suction plate 39, which is supported by L-shaped arms 38, is rotated to cover the top face A of the package 1, and the bonded flaps $a_1$ and $a_2$ on the top face A are suction-held with the suction pads provided on the top suction plate 39. The package 1 itself is held at the lower side or lower part thereof by suction or pressure from four directions. Therefore, a gap is formed between the bonded flaps $a_1$ and $a_2$ on the one hand and, on the other, the packaged items 2 in the package 1 and the folded edges $b_1'$, $b_2'$, $c_1'$ and $c_2'$. In this state, the cutting plate members 6 and 7 on the respective carriages 36 and 37, which are disposed on both sides of the package 1, are inserted into the gap in the package 1 to perform a cutting operation. First, the left cutting plate member 6 is advanced and inserted into the space between the bonded flaps $a_1$ and $a_2$ and the folded edges $b_1'$ and $b_2'$ of the packaging material 3, which are folded under the bonded flaps $a_1$ and $a_2$. In this state, the cutting plate member 6 is advanced to cut the packaging material 3 along the edges $e_1$ and $e_2$ as far as an approximately middle position on the top face A. Because the left and right cutting blades of the cutting plate member 6 and those of the cutting plate member 7 are staggered in an opposite positional relation to each other, cutting along the edge $e_1$, which is on the far side, is partially effected. That is, on the far side of the top face A, the packaging material 3 is cut only at a portion thereof where the folded edges $b_1'$ and $b_2'$ are present. After the cutting plate member 6 has been withdrawn, the right cutting plate member 7 is similarly advanced to effect cutting in the same way as in the case of the left cutting plate member 6. In this case, the bonded flaps $a_1$ and $a_2$ are cut as shown in FIG. 4. When the top suction plate 39 is rotated to open the top face A, the cut portion of the bonded flaps $a_1$ and $a_2$ is suction-held by the top suction plate 39 and opened to the rear side (see FIG. 15).

When the top face A is opened, the folded edges $b_1'$ and $b_2'$ ($c_1'$ and $c_2'$), which are folded from each side face, are present at the top face A. Therefore, opening arms 40 and 41 are moved to respective positions above the side faces of the package 1. Then, the folded edges $b_1'$, $b_2'$, $c_1'$ and $c_2'$ are suction-held with suction pads at the respective distal ends of the arms 40 and 41 and opened to both lateral sides of the package 1 (see FIG. 16). With the folded edges $b_1'$, $b_2'$, $c_1'$ and $c_2'$ opened to the sides by suction, the holder 52 of the unloader 50, which is standing by above the package 1, is lowered, and the holding members 53 and 53' are inserted into the gaps between the packaging material 3 and the packaged items 2 at both sides of the package 1. At this time, because the lower part of the package 1 is pressed from both sides thereof by the retainers 35 and 35', the packaged items 2 are contracted in the longitudinal direction. Therefore, a gap is surely produced between the packaging material 3 and the packaged items 2 at each side of the package 1. When inserted to an extent more than a half the height of the package 1, the holding members 53 and 53' are slightly moved toward each other to hold the packaged items 2 with a certain level of pressure (see FIG. 17). When the packaged items 2 are held by the holding members 53 and 53' in this way, the outside of the package 1 is held at the front and rear sides thereof by the suction pads of the touch plates 33 and 33' and also held at the lower portions of the side faces thereof by the retainers 35 and 35'. Therefore, raising the holder 52 enables only the packaged items 2 to be removed from the packaging material 3. The arrangement may be such that suction pads are provided at the package opening position of the package-opening table 30, and the portion of the table 30 provided with the suction pads is adapted to be capable of lowering. In this case, with the packaged items 2 held by the holder 52, the portion provided with the suction pads is lowered to remove the packaging material 3 from the packaged items 2.

The package opening method and apparatus according to the present invention, which utilize the bonded portions of a package, provide the following advantageous effects.

The package opening method according to the present invention enables a package to be opened mechanically and automatically without the need for a manual operation. Therefore, the packaged items can be supplied in conformity to an automatic machine operation carried out at the subsequent step. Moreover, according to the method of the present invention, the packaging material is cut by utilizing the bonded portions of the package, that is, by inserting a plate member with cutting blades or a plate member as a backplate into the space between the bonded flaps and the packaged items. Accordingly, the package can be opened without damaging the packaged items.

Thus, the packaging material is cut by utilizing the bonded portions of the package, and at the following step, the package is opened by using suction pads, and the packaged items are taken out by using a pair of holding members. Therefore, the package can be opened without damaging the packaged items, and only the packaged items can be supplied quickly to the subsequent step.

The package opening apparatus according to the present invention can be installed along the flow of a production process at a step preceding a machine that uses the packaged items, and the apparatus enables the package to be opened without damaging the packaged items.

According to the present invention, a plate member with cutting blades is inserted into the space under the bonded portions of the packaging material at one face of the package, thereby cutting the packaging material along two edges of the face at the same time with the cutting blades facing outward. The cutting blades are not directed toward the packaged items. Therefore, the packaging material can be cut without damaging the packaged items.

Alternatively, a plate member is inserted into the space under the bonded portions of the packaging material at one face of the package, and cutting blades are pressed and moved to cut the packaging material on the plate member used as an underlay. Therefore, the packaging material can be cut without damaging the packaged items. If the plate member is provided with grooves for engagement with the cutting blades, cutting can be effected even more safely and surely.

In addition, the package opening apparatus according to the present invention enables the package to be opened mechanically, automatically, safely and surely without the need for a manual operation, and hence allows the packaged items to be supplied in conformity to an automatic machine operation carried out at the subsequent step.

According to the present invention, the packaging material is cut by utilizing the bonded portions of the package, that is, by inserting a plate member with cutting blades or a plate member as a backplate into the space between the bonded flaps and the packaged items, and the rest of the package opening operation is carried out by using suction pads and so forth. Therefore, even if the package opening operation is mechanized, the package can be surely opened without damaging the packaged items.

It should be noted that the present invention is not necessarily limited to the foregoing embodiments but can be modified in a variety of ways without departing from the gist of the present invention.

What is claimed is:

1. A method of opening a substantially parallelepipedic package wrapped with a packaging material, said package having a pair of cooperating flaps that traverse edges of said package and are bonded to each other at each of three faces of said package, comprising the steps of:

at at least one of said three faces, forming a gap between said flaps, on the one hand, and, on the other hand, packaged items and a folded edge of said packaging material;

inserting a plate member having oppositely spaced parallel sides containing cutting blades at one side or both sides thereof into said gap to dispose said sides of said plate member adjacent said edges of said package; and cutting said packaging material along said edges of said plate member by using said cutting blades upon moving said plate member along said gap to thereby open said package.

2. A method according to claim 1, including the step of inserting said plate member into said gap from each side of said package.

3. A method according to claim 2, including the step of forming said gap by raising only said flaps by the use of suction pads.

4. A method of opening a substantially parallelepipedic package wrapped with a packaging material, said package having a pair of cooperating flaps that traverse edges of said package and are bonded to each other at each of three faces of said package, said method comprising the steps of:

inserting, at a top face among said three faces, a plate member having cutting blades at one side or both sides thereof into a gap between said flaps, on the one hand, and, on the other hand, packaged items and folded edges of said packaging material which are folded from side faces of said package to dispose said sides of said plate member adjacent said edges of said package;

cutting said packaging material with a cutting blade along at least one edge of said package by moving said plate member with respect to said at least one edge;

opening a cut portion of said packaging material by using suction pads;

opening said folded edges of said packaging material outwardly with suction pads to expose said package;

inserting a pair of holding members into two ends of said package from said opened top face of said packaging material to hold said packaged items; and taking out said packaged items from said package.

5. A package opening apparatus comprising:

a package-opening table for placing thereon a substantially parallelepipedic package formed by wrapping packaged items in a packaging material in such a way that said package has a pair of flaps that traverse edges of said package and are bonded to each other at each of at least three adjacent faces thereof;

first movable suction pads for holding by suction the bonded flaps that are formed on a face of said package parallel to said package-opening table, and operative, upon moving, to form a gap between said bonded flaps held by suction and said packaged items;

a plate member operative to be inserted into said gap between said bonded flaps and said packaged items, said plate member having cutting blades at side edges thereof to cut said bonded flaps along edges of said face of said package;

a movable carriage supporting and guiding said plate member so that said plate member can be advanced and withdrawn with respect to a direction in which it is inserted into said gap;

said first movable suction pads containing means for removing by suction said bonded flaps from said face of said package following cutting by said cutting blades on said plate member;

second movable suction pads for opening by suction a folded edge of said packaging material lying under said bonded flaps when folded, thereby opening said packaging material to expose a face of said package;

a holder operative to hold said packaged items at the opened face of said package; and means for advancing and withdrawing said holder toward and away from said opened face of said package.

* * * * *